US010196255B2

(12) United States Patent
Henriquez

(10) Patent No.: US 10,196,255 B2
(45) Date of Patent: Feb. 5, 2019

(54) PORTABLE WINE DISPENSER

(71) Applicant: Raoul Henriquez, Oranjestad (AW)

(72) Inventor: Raoul Henriquez, Oranjestad (AW)

( * ) Notice: Subject to any disclaimer, the term of this patent is extended or adjusted under 35 U.S.C. 154(b) by 44 days.

(21) Appl. No.: 15/355,564

(22) Filed: Nov. 18, 2016

(65) Prior Publication Data

US 2017/0203949 A1 Jul. 20, 2017

Related U.S. Application Data

(60) Provisional application No. 62/279,192, filed on Jan. 15, 2016.

(30) Foreign Application Priority Data

Mar. 30, 2016 (AW) ..... OCT-01/160330

(51) Int. Cl.

| | |
|---|---|
| ***B67D 1/08*** | (2006.01) |
| ***B67D 1/00*** | (2006.01) |
| ***B67D 1/10*** | (2006.01) |
| ***F25D 11/02*** | (2006.01) |
| ***F25D 25/02*** | (2006.01) |

(Continued)

(52) U.S. Cl.

CPC ..... *B67D 1/0858* (2013.01); *B67D 1/0004* (2013.01); *B67D 1/06* (2013.01); *B67D 1/0801* (2013.01); *B67D 1/0892* (2013.01); *B67D 1/10* (2013.01); *F25D 11/02* (2013.01); *F25D 25/024* (2013.01); *F25D 31/006* (2013.01); *B67D 2210/00031* (2013.01); *B67D 2210/00104* (2013.01); *B67D 2210/00133* (2013.01); *F25D 2331/801* (2013.01); *F25D 2400/06* (2013.01); *F25D 2400/12* (2013.01); *F25D 2400/38* (2013.01); *F25D 2500/02* (2013.01)

(58) Field of Classification Search

CPC .. B67D 1/0858; B67D 1/0004; B67D 1/0801; B67D 1/0892; B67D 1/10; B67D 2210/00104; B67D 2210/00133; F25D 11/02; F25D 31/006; F25D 25/024; F25D 2400/38; F25D 2331/801

USPC ..... 222/105

See application file for complete search history.

(56) References Cited

U.S. PATENT DOCUMENTS

| | | | | |
|---|---|---|---|---|
| 2,293,961 A * | 8/1942 | Zimmerman | ..... | F25D 3/06 220/1.5 |
| 3,331,536 A | 7/1967 | De Lorenzo | | |
| 3,845,787 A | 11/1974 | Slagle | | |

(Continued)

FOREIGN PATENT DOCUMENTS

| | | |
|---|---|---|
| CN | 201825720 | 5/2011 |
| GB | 2 227 824 | 8/1990 |

(Continued)

*Primary Examiner* — Donnell A Long

(74) *Attorney, Agent, or Firm* — Ostrolenk Faber LLP

(57) ABSTRACT

A wine dispenser that includes a wine refrigerator unit having at least two independent temperature-controlled compartments, each one of the two compartments having a plurality of supports to support a wine container, and a wine dispenser unit residing atop the wine refrigeration unit, the wine dispenser unit including a plurality of fountain heads, each one of the plurality of fountain heads being connected to a respective fluid-tight wine supply line that extends from the fountain head to an interior of a respective one of the two independent temperature-controlled compartments.

16 Claims, 4 Drawing Sheets

(51) Int. Cl.
*F25D 31/00* (2006.01)
*B67D 1/06* (2006.01)

(56) References Cited

U.S. PATENT DOCUMENTS

| | | | | |
|---|---|---|---|---|
| 3,933,275 | A | 1/1976 | Metzner et al. | |
| 3,940,019 | A | 2/1976 | Kross et al. | |
| 3,993,218 | A | 11/1976 | Reichenberger | |
| 4,027,783 | A | 6/1977 | Branch et al. | |
| 4,120,425 | A | 10/1978 | Bethurum | |
| 4,276,999 | A | 7/1981 | Reichenberger | |
| 4,304,341 | A | 12/1981 | Shirley | |
| 4,433,795 | A | 2/1984 | Maiefski | |
| 4,462,220 | A | 7/1984 | Ianelli | |
| 4,518,104 | A | 5/1985 | Iannelli et al. | |
| 4,691,842 | A | 9/1987 | Foures | |
| 4,702,396 | A | 10/1987 | Gwiazda | |
| 4,706,847 | A | 11/1987 | Sankey et al. | |
| 4,901,887 | A | 2/1990 | Burton | |
| 4,932,561 | A | 6/1990 | Boxall | |
| 5,000,351 | A | 3/1991 | Rudick | |
| 5,031,799 | A | 7/1991 | Owen | |
| 5,251,790 | A | 10/1993 | Cohn et al. | |
| 5,379,916 | A | 1/1995 | Martindale et al. | |
| 5,381,926 | A | 1/1995 | Credle, Jr. et al. | |
| 5,788,121 | A * | 8/1998 | Sasaki | B65D 77/065 222/105 |
| 5,791,517 | A | 8/1998 | Avital | |
| 5,953,923 | A | 9/1999 | Davies | |
| 6,010,043 | A | 1/2000 | Williamson et al. | |
| 6,422,422 | B1 | 7/2002 | Forbes | |
| 6,481,238 | B1 | 11/2002 | Jennings et al. | |
| 7,022,283 | B2 | 4/2006 | McGuire et al. | |
| 7,076,966 | B2 | 7/2006 | Mullen | |
| 7,147,134 | B2 | 12/2006 | Gutierrez et al. | |
| 7,156,259 | B2 | 1/2007 | Bethuy et al. | |
| 7,464,567 | B1 | 12/2008 | Crossley et al. | |
| 7,555,980 | B2 | 7/2009 | Howard et al. | |
| 7,577,498 | B2 | 8/2009 | Jennings et al. | |
| 7,712,631 | B2 | 5/2010 | Taradalsky et al. | |
| 7,762,431 | B1 | 7/2010 | Tuyls et al. | |
| 7,823,411 | B2 | 11/2010 | Gagliano et al. | |
| 8,333,302 | B2 | 12/2012 | Fukunaga | |
| 8,459,503 | B2 | 6/2013 | Groesbeck | |
| 8,479,955 | B2 | 7/2013 | Vesborg et al. | |
| 8,505,318 | B2 | 8/2013 | Wittern, Jr. et al. | |
| 8,584,716 | B2 | 11/2013 | Bertucci et al. | |
| 8,584,900 | B2 | 11/2013 | Metropulos et al. | |
| 8,800,814 | B2 | 8/2014 | Braun et al. | |
| 8,820,094 | B1 | 9/2014 | Casher et al. | |
| 8,857,666 | B2 | 10/2014 | O'Keefe, Jr. | |
| 9,090,449 | B2 | 7/2015 | Crisp, III | |
| 9,102,508 | B2 | 8/2015 | O'Keefe, Jr. et al. | |
| 9,146,054 | B2 | 9/2015 | Moezidis et al. | |
| 2007/0214055 | A1 | 9/2007 | Temko | |
| 2008/0251536 | A1 | 10/2008 | Wong | 222/146.6 |
| 2009/0014466 | A1 | 1/2009 | Saveliev et al. | |
| 2009/0078721 | A1 | 3/2009 | Hoffman et al. | |
| 2009/0211054 | A1 * | 8/2009 | Frame | A47C 19/024 16/45 |
| 2010/0084426 | A1 | 4/2010 | Devers et al. | |
| 2010/0132831 | A1 | 6/2010 | Waroux et al. | |
| 2010/0199709 | A1 | 8/2010 | Holland et al. | |
| 2011/0000250 | A1 | 1/2011 | Sommerfield et al. | |
| 2011/0204093 | A1 | 8/2011 | Lee | |
| 2011/0253746 | A1 * | 10/2011 | O'Keefe, Jr. | B67D 1/0005 222/132 |
| 2013/0326844 | A1 * | 12/2013 | Stoehr | B60B 27/001 16/46 |
| 2014/0103549 | A1 | 4/2014 | Staneland | |
| 2014/0166694 | A1 | 6/2014 | Otto | |
| 2016/0109175 | A1 * | 4/2016 | Mackey | F25D 31/006 62/3.64 |
| 2016/0185586 | A1 * | 6/2016 | Showalter | B67D 1/0804 366/314 |
| 2016/0257549 | A1 * | 9/2016 | Volftsun | B67D 1/0007 |

FOREIGN PATENT DOCUMENTS

| | | |
|---|---|---|
| JP | 2006-27724 | 2/2006 |
| WO | WO 94/03780 | 2/1994 |
| WO | WO 96/27552 | 9/1996 |
| WO | WO 2015/035471 | 3/2015 |

* cited by examiner

PORTABLE WINE DISPENSER

CROSS-REFERENCE TO RELATED APPLICATION

The present application claims priority to U.S. Provisional Application Ser. No. 62/279,192, filed Jan. 15, 2016, the entire disclosure of which is incorporated by reference herein.

FIELD OF INVENTION

The present invention relates to an apparatus and a method for serving wine and in particular to a portable wine dispenser and a method of serving wine with a portable wine dispenser.

BACKGROUND

Wine is a common beverage served at functions such as wedding receptions, at parties, at resorts and so on.

A conventional method of serving wine is from a bottle. In a function, at a bar or at a restaurant, for example, wine is poured into a glass from a bottle and served in the glass. At a bar, a restaurant or a resort, for example, to serve a great number of people efficiently many bottles of wine are usually opened simultaneously to enable the servers to serve the wine quickly.

It is known that once a bottle of wine is opened it is susceptible to spoilage. To slow down the spoilage process the wine bottles should be capped after each pour, but usually this does not happen. Capping can prevent oxygen from interacting with the wine, but still traps oxygen inside the bottle. Thus, capping is not an effective method of maintaining the quality of the wine in a bottle for a long period of time.

Ideally, the wine from the bottle that was first opened is served first before wine is served from another bottle. Realistically, it is practically impossible to keep track of which wine bottle was opened before another bottle given the pace of service in a setting such as a restaurant, a cruise ship, a resort, or the like. Thus, in places like resorts or cruise ship where bar service is available nearly all day the quality of the wine that is poured can vary. Furthermore, usually any wine that is left over is discarded after the event or the closing of the bar.

Furthermore, this conventional method of serving wine at a function, a resort, a cruise ship or the like setting produces a large number of empty bottles on a daily basis, which can be a problem, specially, on a cruise ship.

To keep wine in an open bottle inert gas or non-reactive gas can be pumped into the open bottle. This method requires additional equipment to store and supply the inert gas.

In addition, another conventional method of serving wine from bottles involves having a service station for the service staff to pour wine for the customers. This method is practiced, for example, on cruise ships and resorts, where at dinner time, for example, hundreds of glasses of wine are poured and served each hour. Clearly, pouring one glass of wine at a time is time consuming and slows down the pace of service. This same problem may also occur at a catered event such as a wedding reception. In addition, the location of the catered event may not have proper facilities for serving wine or liquor, which means a "make-shift" wine service facility with a large footprint (e.g. a long table supporting many open bottles of wine) may need to be set up somewhere for the service staff to pour wine into glasses. The service facility may need to be constantly supplied with open bottles of wine to ensure efficient service for the event.

SUMMARY

An objective of the present invention is to provide a wine dispenser that is compact and occupies a small footprint while storing the equivalent of at least two cases of wine.

Another objective of the present invention is to provide a portable wine dispenser that can be easily transported from one location to another.

Another objective of the present invention is to provide a wine dispenser that stores wine without spoilage for a long period of time without the use of inert or otherwise non-reactive gases.

Another objective of the present invention is to provide a wine dispenser that can speed up the serving of wine by two or more service staff.

Another objective of the present invention is to provide a wine dispenser that can supply wine at proper serving temperature.

Another objective of the present invention is a wine dispenser that can supply at least two different kinds of wine (e.g. white and red) at different temperatures, each temperature being suitable for a respective one of the at least two different wines.

Another objective of the present invention is to provide a wine dispenser that does not supply wine from bottles.

DETAILED DESCRIPTION

Figure 1:
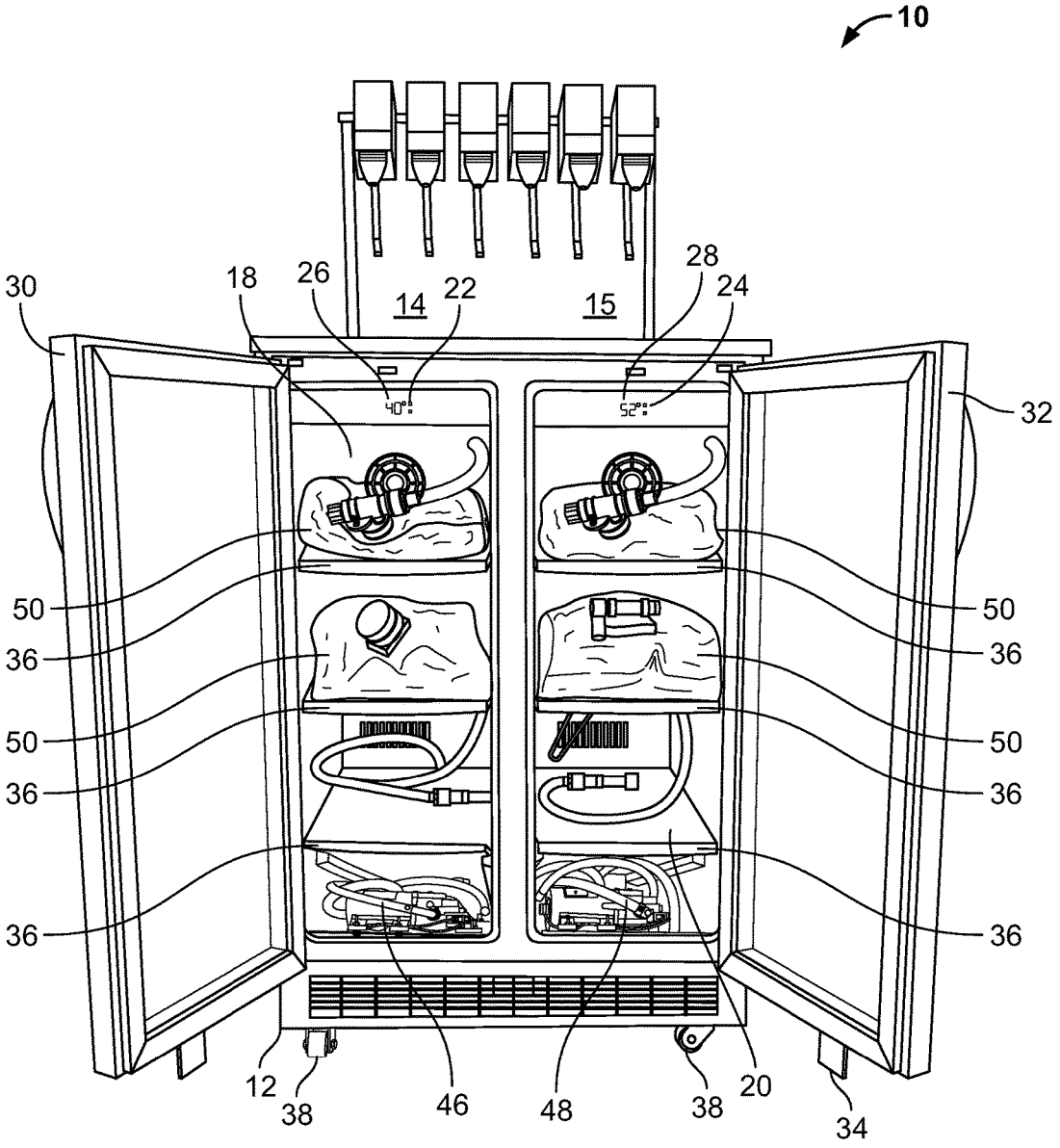
FIG. 1 shows a front view of a portable wine dispenser according to the present invention with the doors of its refrigerated compartments open.

Referring to FIG. 1, the present disclosure relates to a portable, electrically operated, wine dispenser 10.

Wine dispenser 10 includes at least a wine refrigerator unit 12, a wine dispenser unit 14, and a plurality of electric pumps 46, 48.

In the preferred embodiment, wine refrigerator unit 12 includes a first temperature-controlled compartment 18 and a second temperature-controller compartment 20. Compartment 18 and 20 could be arranged lateral to one another (side-by-side).

Alternatively, first compartment 18 could be arranged above second compartment 20, or vice versa.

The temperature inside each compartment 18, 20 could be controlled independent of the other compartment. Each compartment 18, 20 may include its own touch-screen control interface 22, 24 and its own digital display 26, 28, which could display the temperature inside the compartment or any other suitable information useful to the user (such as the volume of wine consumed or remaining in the stored bags or the like information).

A first door 30 may be provided to prevent or to provide access to the interior of first compartment 18.

A second door 32 may be provided to provide or to prevent access to second compartment 20.

A lock 34 may be provided to lock each door 30, 32.

Each door 30, 32 may include a transparent window to allow viewing of the interior of the compartment. A light or the like may also be provided inside each compartment 18, 20 to illuminate the interior thereof.

The temperature inside first compartment 18 may be controlled to fall in one range, for example, 34°–43° F., which cover suitable serving temperatures for white wines.

The temperature inside second compartment 20 may be controlled to fall in a second range, for example, 40°-60° F., which cover suitable serving temperature for red wines.

Thus, refrigerator unit 12 is configured to provide at least two cooled zones each for a respective type of wine.

A plurality of slideable supports 36 may be provided inside each compartment 18, 20. Each slideable support 36 may be a rack, a panel (e.g. a glass panel) or the like and is arranged to slide into and out of a compartment 18, 20. Each support 36 provides enough area for at least one wine bag 50 that is filled with wine. Each support 36 is configured to support the weight of at least one bag 50 filled with wine.

In the preferred embodiment, each wine bag 50 can contain at least five liters, but preferably at least nine liters, of wine (which is approximately equivalent to a case of wine), and more preferably at least ten liters of wine.

Each wine bag 50 may an oxygen-impermeable bag made, for example, with metal-coated polymer or another type of polymer that is oxygen-impermeable. The material for construction of such bags is well known and typically used in bag-in-box products for packaging wine.

The footprint of refrigerator unit 12 may be no more than 24 inches (width), by 24 inches (depth), which is a conventional footprint for under the counter appliances. The height of unit 12 may be less than 35 inches, whereby the refrigerator unit 12 may be received under a bar counter, for example, at a conventional height. Thus, unit 12 occupies a small footprint and is relatively compact.

Refrigerator unit 12 may have a plurality of casters 38 (e.g. four casters) or the like installed on or otherwise attached to its base, whereby dispenser 10 is rendered portable from one location to another location by pushing or pulling without the need of any machinery. Casters 38 are selected to support the weight of dispenser 10 (when stationary and moving) when unit 12 is filled with full wine bags (e.g. 350 pounds).

It has been found that a swivel caster with a polyurethane wheel with a maximum load capacity of 220 pounds and a wheel diameter of 35 mm works well for a caster 13. An example of such a caster is a Blickle caster, a description of which is included in the Appendix. The polyurethane wheel produces less noise, and, while robust, it does not cause damage to, for example, tile, stone, or wood flooring. Thus, an apparatus according to the invention can be safely transported over unprotected, hard surfaces, without causing damage to the surface.

Wine dispenser unit 14 resides on or over the top surface of refrigerator unit 12. Wine dispenser unit 14 may be attached to unit 12, or may simply reside on unit 12 without an attachment so that it may be easily removed for servicing or replaced with another type of dispenser.

Figure 2:
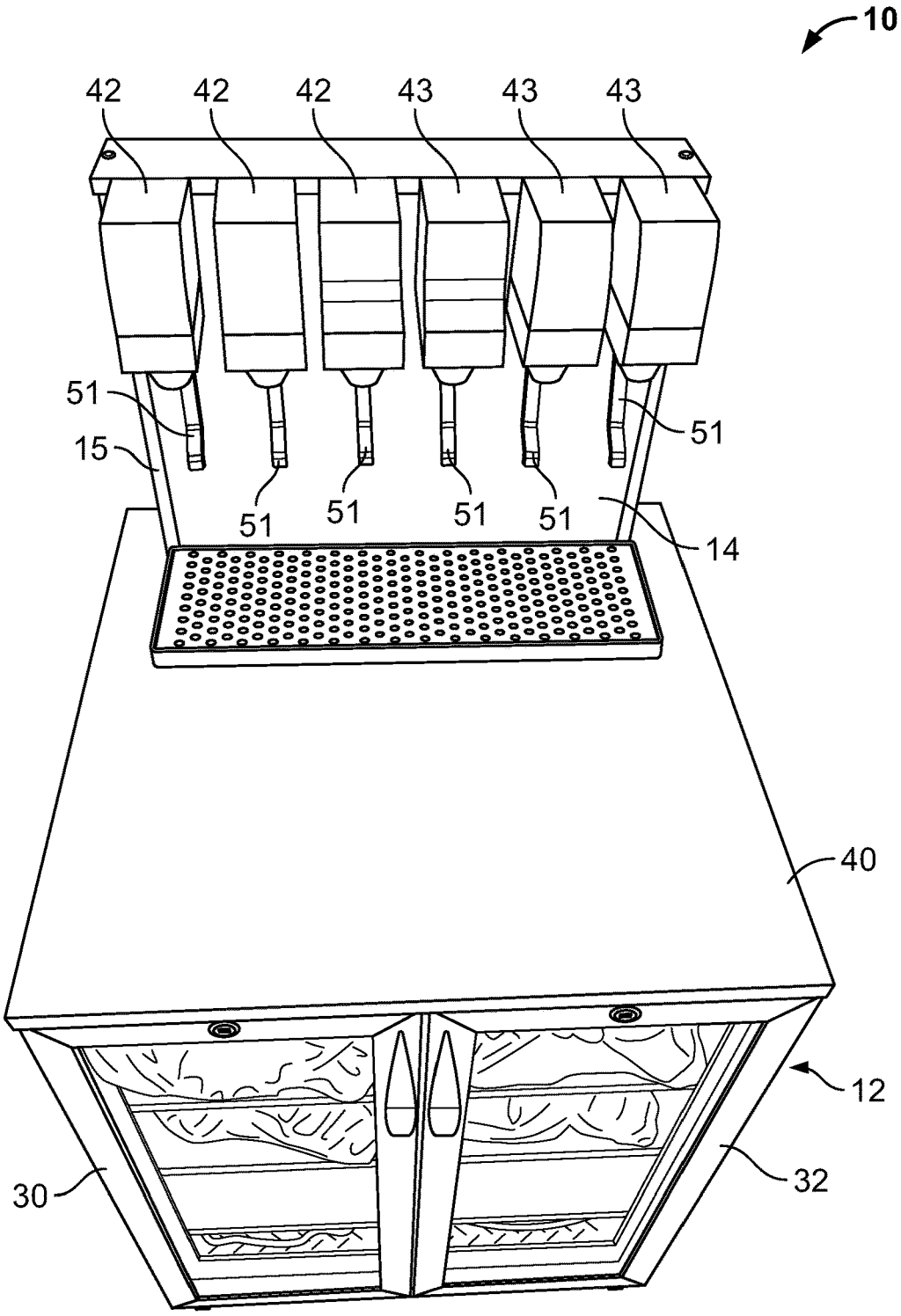
FIG. 2 shows a top perspective view of the portable wine dispenser shown in FIG. 1.

Referring to FIG. 2, optionally, a countertop 40 may be provided and dispenser unit 40 may be integrated with counter top 40. Thus, for example, an opening may be provided in countertop 40 to receive the base of dispenser unit 40 to hide the bottom edges of the base and provide a more pleasing appearance. Countertop 40 may be made of a synthetic material or a natural material such as granite or the like.

Dispenser unit 14 includes a plurality individually operable fountain heads 42,43. Each fountain head 42,43 is connected to a respective wine supply tube 44,45 exiting from the interior of a respective compartment 18,20.

The wine to each fountain head 42,43 is supplied under pressure from a respective pump 46,48. According to an aspect of the present invention pumps 46 and 48 are electrically operated to generate pressure, and do not rely on gas pressure to create fluid pressure to supply wine to the fountain heads.

In the preferred embodiment, a first pump 46 provides the pressure to supply wine stored in a bag 50 in first compartment 18 to at least one first fountain head 42, and a second pump 48 provides the pressure to supply wine stored in a bag 50 in second compartment 20 to at least one second fountain head 43.

In the preferred embodiment, first compartment 18 can store three bags 50 on three separate shelves. Each bag 50 supplies wine via a respective pump 46 to a respective fountain head 42. Thus, in the preferred embodiment, there will be three first pumps 46 each supplying wine from a respective bag 50 to a respective fountain head 42. First pumps 46 will be stored in compartment 18, preferably on a bottom shelf.

Similarly, in the preferred embodiment, second compartment 20 can store three bags 50 on three separate shelves. Each bag 50 supplies wine via a respective pump 48 to a respective fountain head 42. Thus, in the preferred embodiment, there will be three second pumps 48 each supplying wine from a respective bag 50 to a respective fountain head 43. Second pumps 48 will be stored in compartment 20, preferably on a bottom shelf.

Figure 3:
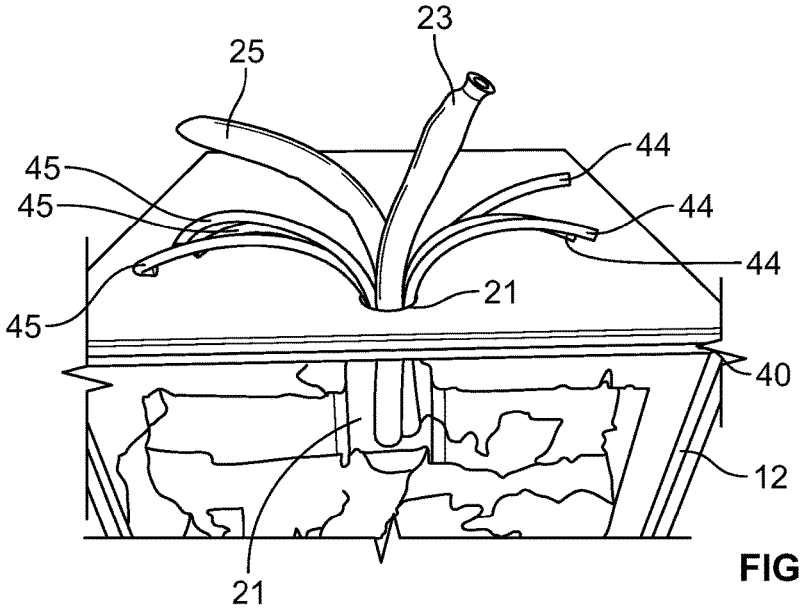
FIG. 3 shows a top, back perspective view of a wine dispenser according to the present invention with the dispenser unit thereof removed to show the wine supply tubes extending from the interior of the refrigerated compartments to the exterior of the refrigerator unit.

Referring to FIG. 3, in the preferred embodiment, first wine supply tubes 44 supply wine from first pump 46 to first fountain heads 42, and a second wine supply tubes 45 supply wine from second pump 48 to a plurality of second fountain heads 43 (e.g. three). Specifically, each first wine supply tube 44 is connected to a respective first pump 46 to receive wine and connected to a respective first fountain head 42 to supply wine, each second wine supply tube 45 is connected to a respective second pump 48 to receive wine and connected to a respective second fountain head 43 to supply wine. Thus, multiple fountain heads may be made available to supply a first kind of wine (e.g. white wine) and a second kind of wine (e.g. red wine). It should be noted that each fountain head may be lever operated like a conventional soda dispenser found in restaurants or self-service soda stations in convenience stores. To operate such a device, a glass may be pushed against lever 51 associated with a fountain head to position the glass below the fountain head to receive wine. Consequently, one server can pour two glasses of wine from two fountain heads supplying, for example, red wine at the same time (instead of pouring one glass of wine at a time from the same bottle of wine) thereby increasing the speed of service. Also, depending on the number of fountain heads, more than one server can pour wine further increasing the speed of service at a location.

Thus, when for example, a wine dispenser according to the present invention is used at a waiters station in a resort or in a cruise ship, a waiter may be able to pour two glasses of wine at the same time, which generally speeds up the service in such a busy setting. Furthermore, a second waiter may be serving two glasses at the same time.

It has been found that a six valve table top soda dispenser works well, and example of which is shown in the Appendix.

Alternatively, a dispenser gun (e.g. fluid dispenser guns used to pour liquor or soda) may be used instead of a soda fountain head. This configuration, is perceived as more aesthetically appealing, and may be better suited when the wine dispenser is to be situated where it is visible by the customers.

According to one aspect of the present invention, first pumps 46 reside within first compartment 18, whereby first pumps 46 are kept at the same temperature as the wine inside first compartment 18.

Similarly, second pumps 48 reside within second compartment 20, whereby second pumps 48 are kept at the same temperature as the wine inside second compartment 20.

Consequently, the wine that is temporarily stored in each pump 46, 48 between each use of a fountain head 42, 43 remains at the temperature of the compartment in which the pump resides. As a result, the location of the pump does not change the service temperature of the wine, which is the temperature of the compartment in which the wine bag 50 is stored.

Figure 4:
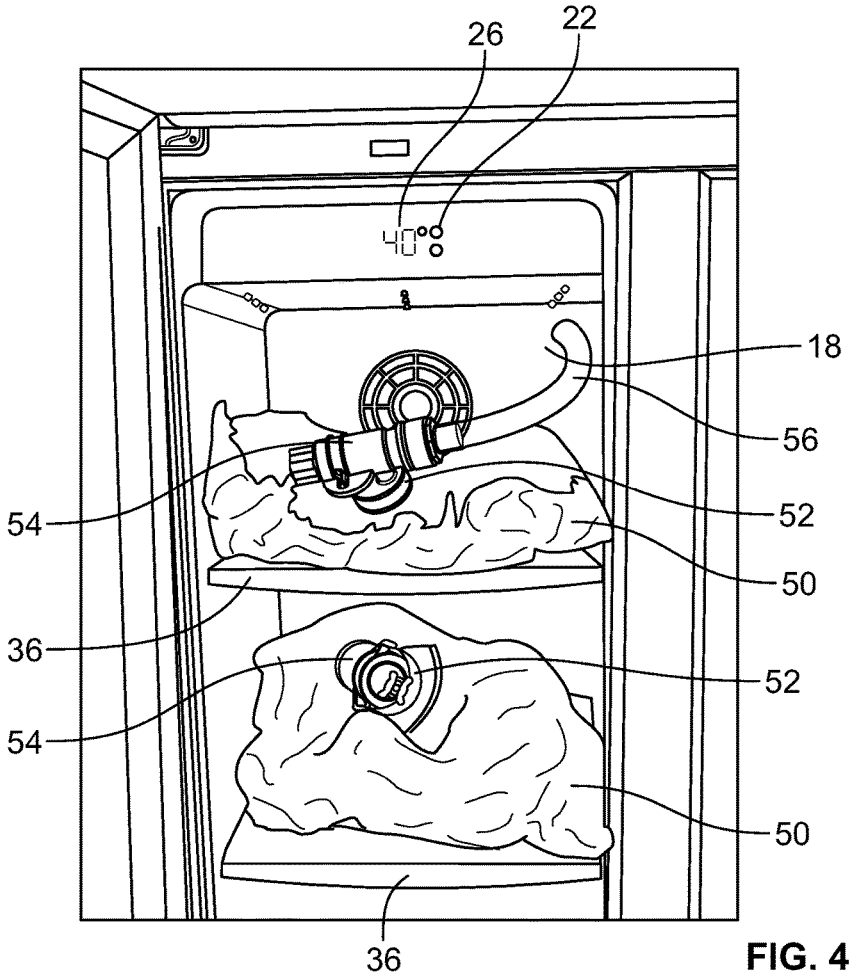
FIG. 4 shows a portion of the interior of one of the refrigerated compartments (the other being functionally similar) in which tapped wine bags are stored on respective slideable support panels.

Furthermore, the wine stored in each compartment 18, 20 resides in a sealed, oxygen impermeable wine bag 50. Referring to FIG. 4, each bag 50 is provided with a tap 52. Tap 52 may be a conventional tap used with, for example, in known wine-in-box type products. Each tap 52 is connected with a respective fluid-tight tap connector 54 to a transfer tube 56. Any known configuration can be used as a tap connector 52 as long as it can be selectively connected and disconnected from the tap 52 of a bag 50, whereby an empty bag can be disconnected and removed and a full bag can be connected to the tap connector 54. Thus, fluid-tight, and air-tight tap connector 54 and tap 52 are detachably connected so that each empty bag 50 may be replaced with another bag 50 filled with wine.

When connected, tap 52 and tap connector 54 form a seal to prevent entry or exit of liquid or gases.

A transfer tube 56 is connected to a respective pump 46,48 in a fluid-tight manner to supply wine to each pump 46,48. Also, each pump 46, 48 is connected to a wine supply tube 44,45 in a fluid tight manner.

Each wine supply tube 44, 45 is connected in a fluid-tight manner to a respective fountain head 42,43. Thus, a fluid-tight wine supply line is established between each bag 50 and a respective fountain head. Consequently, according to another aspect of the present invention, once wine fills the supply line from a bag 50 to a fountain head, the wine is protected from relatively spoilage due presence of oxygen. Thus, it is not necessary to supply an inert gas or the like fluid into the supply line after a bag 50 is tapped in order to keep the wine from spoiling quickly.

According to an aspect of the present invention, a bag 50 is filled with wine before it is tapped. If necessary a little inert (inactive or passive) gas may reside in each bag 50 when it is filled to prevent spoilage of the wine in transit and storage. The tap of the bag is closed to define an untapped filled wine bag 50 that contains a volume of wine (e.g. at least nine liters) and if necessary a volume of gas that does not spoil wine (e.g. nitrogen).

Once the untapped filled bag 50 is placed inside unit 12 and tapped (i.e. its tap connected to a respective tap connector) the pump connected to the connected tap connector draws out the wine (for example, when a lever of a fountain head connected to the pump is operated to allow fluid to exist through the fountain head), and fills the transfer tube that is connected to the connected tap connector. The drawn wine is then pushed through the wine supply tube that is connected to the pump until it exist the fountain head. Thus, the wine supply line that includes at least the tap, the tap connector, the transfer tube, the pump, and the wine supply tube are filled with wine, and air (oxygen) will not enter back into the wine supply line once the fountain head connected to the route is closed by releasing the lever associated with the fountain head. Consequently, any gas (e.g. oxygen) that may spoil the wine will be prevented from spoiling the wine residing in the wine line and the bag connected to the wine line, thereby realizing a state in which wine is stored with less concern for spoilage due to spoiling gas (air, oxygen) activity.

To further ensure that oxygen does not enter the wine route, a one-way check valve can be provided between dispenser unit 14 and the wine supply line to permit the exit of wine from the wine supply line but prevent entry of other substances, in particular oxygen, into the wine supply line. Thus, an oxygen-tight wine supply line can be established that extends from the interior of a wine bag 50 to the point of entry into a respective fountain head 42, 43.

According to another aspect of the present invention, the entire length of a wine supply route from each bag 50 connected to each wine supply line is inside a refrigerated zone of a respective compartment 18,20. That is, each bag 50, its tap 52, a tap connector 54 connected to the tap 52 of the bag 50, the transfer tube 56 connected to the tap connector 54 that is connected to the tap 52 of the bag 50, and a pump 46 or 48 connected to the transfer tube 56 are all located inside a respective compartment 18 or 20. The wine supply tube 44,45 of each wine supply line may reside partially inside a compartment 18,20, and extend partially outside of a compartment 18, 20 into a common riser passage 21 (see FIG. 3). Preferably, the volume of wine residing in each portion of a wine supply tube 44,45 in the riser 21 contains no more than 6 fluid ounces of wine (less than one glass of wine). As the riser passage 21 is insulated from compartments 18, 20, the portion of each wine supply tube 44,45 residing in riser 21 may be thermally insulated to avoid being warmed up or cooled down in order to ensure that the entire route from a wine bag 50 to the dispenser unit 14 remains at the same temperature. Thus, the temperature of the wine supplied from each wine line corresponds to the temperature of a compartment in which the bag connected to the wine line resides.

Referring to FIG. 3, a first air supply tube 23 may extend from first compartment 18 into passage 21, and then outside of the refrigerated zone. A second air supply tube 25 may extend from second compartment 20 into passage 21 and then outside of the refrigerated zone. The air supply tubes 23, 25 may then supply air from compartments 18,20 into the interior of casing 15 of dispenser unit 14, whereby the temperature of the interior of casing 15 (in which portions of tubes 44,45 reside) can be kept closer to the temperatures inside of compartments 18,20.

The tubes 44,45,56 may be sanitized and may be flexible and transparent. Tubes 56 may be long enough to permit a bag 50 connected to a wine supply line to be removed by sliding out a support 36 from the interior of unit 12. That is, each tube 56 may be longer than is necessary for connection to a pump in order to provide some slack in the line.

According to an aspect of the present invention, each untapped bag 50 may reside in a cardboard box in a manner similar to a wine-in-a-box configuration, which is well known. Each untapped wine bag 50 may be shipped in the box. However, it should be noted that, according to another aspect of the present invention, each bag 50 is not placed inside a compartment 18 or 20 while it is in its box as it has been found that the box provides thermal insulation to the bag and prevents or otherwise interferes with proper refrigeration and temperature control of the wine contained in the bag. Thus, while an untapped bag 50 may be shipped in a box, it is first removed from its box, placed on a panel in a compartment 18 or 20, tapped as described earlier, and the fountain head connected to the tapped bag is operated to at least fill the wine supply connected to the fountain head under the pressure from a respective pump. Thereafter, the wine in the bag and its connected wine supply line is permitted to reach the temperature of the compartment in which the bag is placed before the wine is served. While removing the box is beneficial, it should be appreciated that, according to the present invention, the bag could be left in the box, and connected to a tap connector in the manner described.

According to another aspect of the present invention, each bag 50 is large enough to contain at least nine liters of wine, which is equivalent to a case of wine. Commonly known wine bags used in wine-in-a-box configuration contain no more than six liters.

Figure 5:
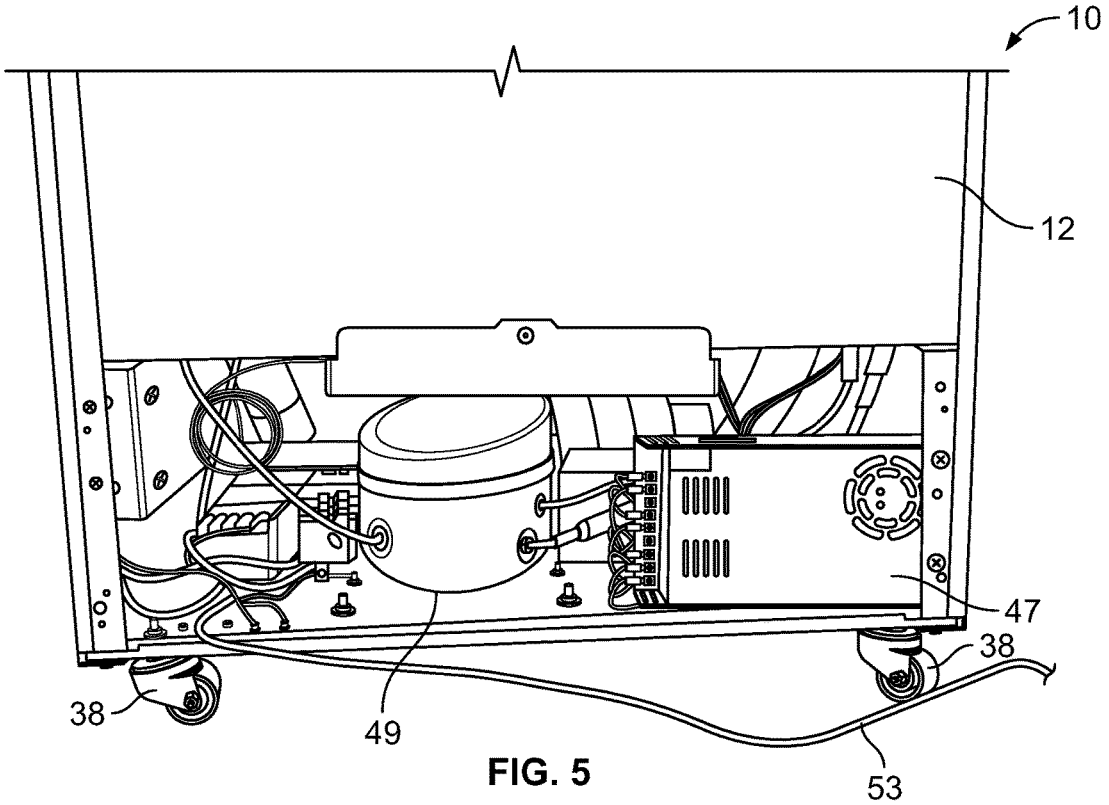
FIG. 5 shows a portion of the back, bottom view of the wine dispenser shown in FIG. 1.

Each pump 46,48 may a variable pressure pump capable of supplying a pressure in the range 15-20 Psi (in use). A suitable pump may be a water pump such as a two chamber positive displacement diaphragm pump, which is self-priming, and capable of being run dry. It has been found that a 24V diaphragm water pump with a variable regulator that is sold by SeaFlow works well. A description of the SeaFlow pump is included in the Appendix. A single transformer may be used to convert the line voltage (110V or 220V) to a suitable voltage and supply power to all pumps at the suitable voltage. If needed, the transformer may convert the AC line power to DC. Referring to FIG. 5, a transformer 47 may be provided to supply regulated power to the pumps 46,48. Transformer 47, which produces heat in operation, is located outside compartments 18,20 along with other components 49 (e.g. compressor etc.) that perform the refrigerating functions for compartments 18,20 in any suitable manner. As is known, compartments 18, 20 are thermally insulated. Thus, minimal heat is supplied into compartments 18,20 by the operation of transformer 47 and components 49. By using pumps that receive their power from a transformer outside of refrigerated zones of compartments 18,20, the introduction of heat into the refrigerated zones is minimized.

A suitable pump for each line is preferably a low voltage pump that does not produce much heat.

Tubes that transfer wine may be flexible, transparent, plastic beverage tubes with a small diameter (e.g. ⅜") to minimize the amount of wine stored therein. Ideally, the total length of the tubes that transfer wine from a box to a fountain head is no longer than six feet, which means that only about 5 fluid ounces (4.47 Oz. or 140 ml) will be stored in each fluid line extending between a box and a fountain head.

Preferably, compartments 18,20 are large enough to receive six filled bags 50 (three in each compartment). The compartments 18,20 may be larger or smaller without deviating from the present invention.

Preferably, all electrical components (pumps, compressors etc.) receive power from a single power line 53. Thus, dispenser 10 according to the present invention only needs one power outlet to operate, which adds to the portability characteristics of dispenser 10.

It should be noted that in the preferred embodiment, the electrical components of the wine dispenser (including the components for operating the refrigerator) are selected so that the dispenser draws about 5 Amps of power. Advantageously, the electrical components are selected to draw no more than 15 Amps, preferably nor more than 10 Amps, whereby the dispenser can receive power from any suitable, conventional power outlet, which is usually interrupted with a 10 or a 15 Amp breaker. Consequently, no special outlet is required to operate a dispenser according to the present invention adding to its portability characteristics.

Figure 6:
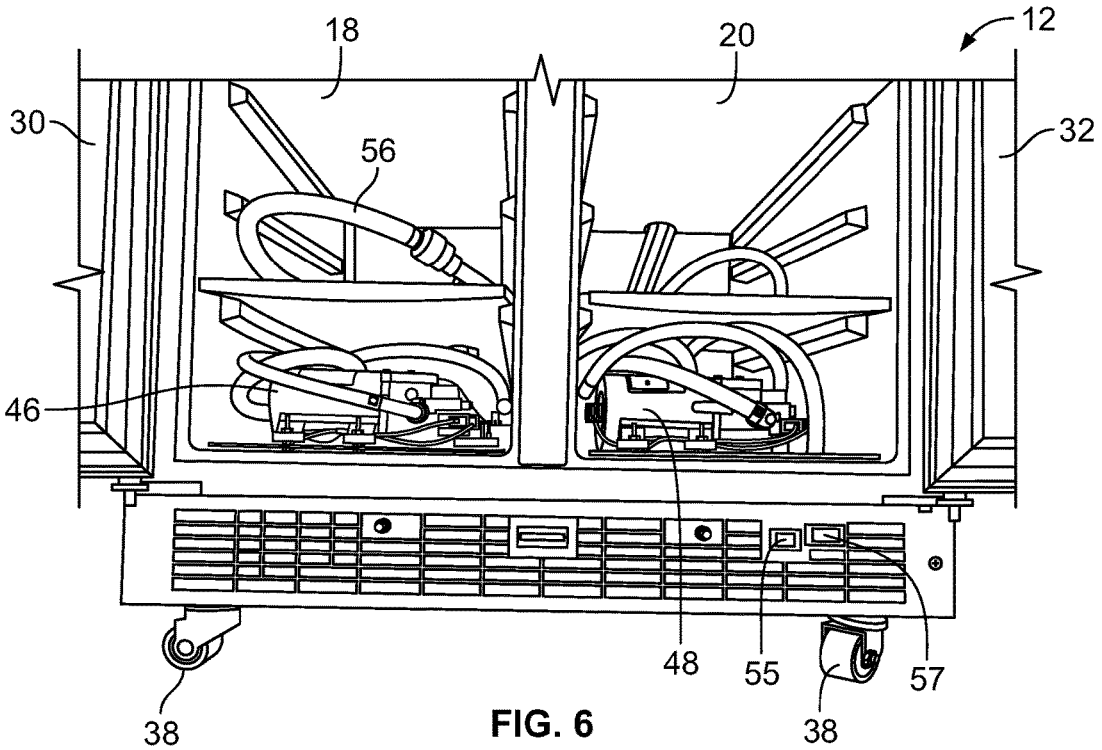
FIG. 6 shows a portion of the bottom, front view of the wine dispenser shown in FIG. 1.

Referring to FIG. 6, preferably, a switch 55 is provided to turn the pumps 46,48 and/or transformer 47 ON/OFF and another switch 57 is provided to switch the refrigerated compartments 18,20 ON/OFF. Thus, when dispenser 10 is not in use the pumps 46,48 and/or transformer 47 may be turned off while the wine stored therein kept at the desired temperatures.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A wine dispenser comprising:

a wine refrigerator unit having at least two independent temperature-controlled compartments, each one of the two compartments having a plurality of supports to support a wine container; and a wine dispenser unit residing atop the wine refrigeration unit, the wine dispenser unit including a plurality of fountain heads, each one of the plurality of fountain heads being connected to a respective fluid-tight wine supply line that extends from the fountain head to an interior of a respective one of the two independent temperature-controlled compartments;

wherein each wine supply line includes at least a tap connector configured for fluid-tight and air-tight connection to a wine container stored in one of the two compartments, a transfer tube, a pump connected to the transfer tube, and a wine supply tube connected to a fountain head; and wherein each pump, each transfer tube and a portion of each wine supply tube of each wine supply line reside in a respective temperature-controlled compartment.

2. The wine dispenser of claim 1, wherein the pump in each wine supply line is an electric pump.

3. The wine dispenser of claim 2, wherein said wine dispenser draws no more than 15 Amps when operating.

4. The wine dispenser of claim 3, further comprising a plurality of casters supporting the refrigerator unit, the casters being capable of supporting at least 350 pounds of weight.

5. The wine dispenser of claim 1, further comprising an insulated riser, wherein another portion of each wine supply tube resides inside of the insulated riser, and at least one air supply tube in the insulated riser connected to a casing of the wine dispenser and supplying air from one of the two compartments to the casing of the wine dispenser.

6. The wine dispenser of claim 5, wherein a portion of each wine supply tube resides outside of the refrigeration unit, and can hold no more than six fluid ounces of volume.

7. The wine dispenser of claim 1, wherein each support is configured to hold a container that contains at least nine liters of wine.

8. The wine dispenser of claim 1, wherein each support is configured to slide in and out of the refrigerator unit.

9. The wine dispenser of claim 1, wherein one of the compartments is configured to have a temperature in the range 34-43 Fahrenheit, and the other compartment is configured to have a temperature in the range 40-60 Fahrenheit.

10. The wine dispenser of claim 1, wherein the refrigerator unit is no more than 35 inches tall.

11. The wine dispenser of claim 1, wherein the foot print of the refrigerator unit is twenty four inches by twenty four inches.

12. The wine dispenser of claim 1, wherein each compartment includes three supports.

13. The wine dispenser of claim 12, wherein each wine container is a wine bag, each support supports a respective wine bag, and each wine bag is connected to a wine supply line.

14. A method of servicing a wine dispenser according to claim 1, the method comprising: receiving a wine container containing wine, the wine container including a wine bag connected to a tap; placing the wine bag on a support in one of the two compartments; and connecting the tap of the wine bag to a wine supply line.

15. The method of claim 14, wherein the wine container includes a box in which the wine bag resides, and further comprising removing the wine bag from its box before placing the wine bag on the support.

16. The method of claim 15, wherein the wine bag contains at least nine liters of wine.

* * * * *